United States Patent [19]

Miyama

[11] Patent Number: 4,532,843

[45] Date of Patent: Aug. 6, 1985

[54] PUNCH PRESS

[75] Inventor: Hidetoshi Miyama, Hadano, Japan

[73] Assignee: Amada Company, Limited, Japan

[21] Appl. No.: 547,951

[22] Filed: Nov. 2, 1983

[30] Foreign Application Priority Data

Nov. 2, 1982 [JP] Japan ..... 57-165715[U]
Nov. 2, 1982 [JP] Japan ..... 57-165716[U]
Nov. 4, 1982 [JP] Japan ..... 57-166198[U]

[51] Int. Cl.[3] ..... B21D 28/02
[52] U.S. Cl. ..... 83/409; 83/549; 83/618; 83/628; 83/700
[58] Field of Search ..... 83/549, 550, 551, 552, 83/409, 618, 628, 699, 700

[56] References Cited

U.S. PATENT DOCUMENTS

| | | | |
|---|---|---|---|
| 494,546 | 4/1893 | Bradley | 83/549 X |
| 1,728,475 | 9/1929 | Cavill | 83/549 X |
| 2,458,160 | 1/1949 | Grappe | 83/549 |
| 3,234,839 | 2/1966 | Smeets | 83/549 |
| 3,717,059 | 2/1973 | Daniels | 83/552 X |
| 3,717,061 | 2/1973 | Daniels | 83/552 X |
| 3,895,550 | 7/1975 | Daniels | 83/549 X |
| 3,921,486 | 11/1975 | Valente | 83/552 X |
| 3,972,260 | 8/1976 | Hayashi et al. | 83/549 |

FOREIGN PATENT DOCUMENTS

| | | | |
|---|---|---|---|
| 1445424 | 5/1966 | France | 83/549 |
| 22579 | of 1892 | United Kingdom | 83/549 |

*Primary Examiner*—Frank T. Yost
*Attorney, Agent, or Firm*—Wigman & Cohen

[57] ABSTRACT

The present invention relates to a punch press having a frame having an overhead beam and base portion, a vertically movable ram mounted at a front end of the overhead beam, a tool holder having upper and lower arms and being disposed on the base portion of the frame with a gap between the tool holder and the overhead beam, a plurality of upper punching tools disposed at a front end of the upper arm of the tool holder, a plurality of lower tools corresponding to the upper tools and disposed at a front end of the lower tool holder, a striker mounted on the ram so as to hit each of the upper punching tools and a workpiece feeding and positioning device disposed on the tool holder. The elements of the invention are arranged such that vibration and shocks occurring during the operation of the ram are not transmitted to the workpiece feeding and positioning device, and the punching tools. Also included is a eccentric member on the ram for performing leftward and rightward adjustment of the ram, and a vibrationally isolated driving means for moving the striker along the ram so as to adjust it over a desired upper punching tool.

10 Claims, 7 Drawing Figures

PUNCH PRESS

BACKGROUND OF THE INVENTION

1. Field of the Invention

The present invention relates generally to a punch press for punching sheet-like workpieces such as sheet metals and, more particularly, to a punch press having a C-shaped frame in which a plurality of pairs of upper and lower punching tools are provided.

2. Description of the Prior Art

Heretofore, punch presses having upper and lower punching tools for punching sheet-like workpieces such as sheet metals have mostly employed C-shaped frames in which an overhead beam is supported by a column above a base in a cantilever manner. The punch presses of the C-shaped frame are advantageous in that they can be assembled and manufactured at comparatively low cost and they are convenient to operate in many respects such as feeding and positioning workpieces to be punched.

The conventional punch presses of the C-shaped frame, however, have had several distinct disadvantages in spite of the advantages. The original disadvantage is that the C-shaped frame is inevitably subjected to deflections of the overhead beam under punching load during punching operations. Also, the deflections of the C-shaped frame will cause change in vertical alignment of the upper and lower punching tools and will result in poor punching accuracy and short life of the punching tools.

In the past, therefore, it has been the general practice of the industry to use massive proportions for the C-shaped frame to overcome the above disadvantages or at least minimize them within some limits. Of course, however, the massive proportions of the C-shaped frame will increase substantially the cost of the press and where deep throats are needed to increase the capacity of the press the massive proportions will take up a substantial amount of the floorspace for the press.

SUMMARY OF THE INVENTION

It is an object of the present invention to provide a punch press having a C-shaped frame in which upper and lower punching tools will be kept in vertical alignment with each other to perform accurate punching operations in spite of the deflections and the resultant vibrations of the C-shaped frame.

It is another object of the present invention to provide a punch press having a C-shaped frame in which a workpiece to be punched will be subjected to less vibrations which are caused by the deflections of the C-shaped frame occuring during punching operations.

It is a further object of the present invention to provide a punch press having a C-shaped frame in which a plurality of pairs of upper and lower punching tools are effectively provided to perform a variety of punching operations acurately and economically.

In order to attain the above objects, a plurality of pairs upper and lower punching tools are held by a C-shaped tool holding means which is mounted on the punch press according to the present invention. According to the present invention, a workpiece feeding and positioning means is also mounted on the C-shaped tool holding means for holding the upper and lower punching tools.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENT

Figure 1:
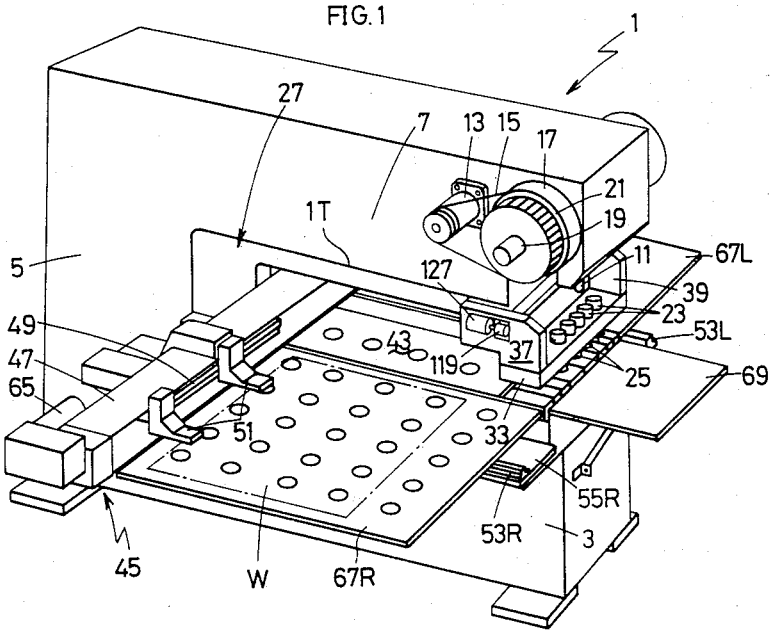
FIG. 1 is a perspective view of a punch press embodying the principles of the present invention.

Referring now to FIG. 1, there is shown a punch press which is generally designated by the numeral 1 and is used to punch sheet-like workpieces such as sheet metals. The punch press 1 is constructed of an elongated base 3, a column 5 vertically fixed to an end of the base 3 and an overhead beam 7 which is integrally connected to the top of the column 5 in a cantilever manner to extend in parallel with the base 3 to provide a throat 1T therebetween. Also, the punch press 1 comprises a ram 9 which is vertically movably disposed at the free end of the overhead beam 7 to move toward and away from the base 3 in operation. The ram 9 is provided at its lower portion with a striker 11 for punching operations which is so disposed as to laterally shift thereon rightward and leftward as will be described in great detail hereinater. Also, the ram 9 is so arranged as to be vertically driven by a motor 13 through a belt 15 and a flywheel 17 having an eccentric shaft 19 and a clutch 21 to perform punching operations.

Figure 2:
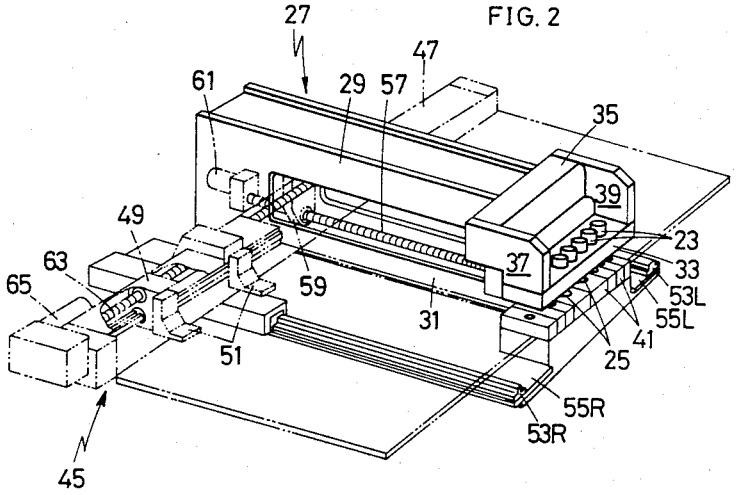
FIG. 2 is a perspective view showing a portion of the punch press shown in FIG. 1.

As best shown in FIGS. 1 and 2, the punch press 1 is provided with a plurality of upper punching tools 23 standing in a horizontal line and a plurality of lower punching tools 25 likewise standing in a horizontal line according to the present invention. More particularly, each of the groups of the upper and lower punching tools 23 and 25 is disposed to be in a horizontal line which is along the X axis or at right angles to the direction of the extension of the elongated base 3. The upper and lower punching tools 23 and 25 are varied in size and shape, and they are so arranged that pairs of the upper and lower tools 23 and 25 common in size and shape are vertically aligned with each other. Thus, the arrangement is such that in punching operations the striker 11 which can laterally shift will be lowered by the ram 9 to act on the pairs of the upper and lower tools 23 and 25 common in size and shape.

In order to hold the upper and lower tools 23 and 25 in the above described manner, there is provided a C-shaped tool holding unit 27 which is mounted on the top of the base 3 in such a manner to extend overall thereon. The tool holding unit 27 is provided with a pair of upper and lower arms 29 and 31 which are so formed as to extend in parallel with each other in the same direction in cantilevered manners to hold the upper and lower tools 23 and 25, respectively. Stated specifically, the upper punching tools 23 are grouped in an elongated upper tool holder 33 in a line, and the tool holder 33 is detachable held by a pair of brackets 37 and 39 which are secured to the end of the upper arm 29 of the tool holding unit 27 by means of a square block 35. Also, the lower punching tools 25 are each held by lower tool holders 41 which are detachably mounted in a line on the end of the lower arm 31 just beneath the upper tools 23. Of course, the upper and lower tools 23 and 25 are held in the horizontal lines on the upper and lower arms 29 and 31 of the tool holding unit 27 so that pairs of them common in size and shape are vertically aligned. In this connection, the striker 11 which is held by the ram 9 is so arranged as to be laterally moved just over the upper and lower tools 23 and 25 to selectively act on a desired pair of them when the ram 9 is lowered. Also, a plate-like fixed table 43 is provided on the lower arm 31 in such a manner as to extend over the base 3 so that a workpiece W to be punched can slide thereon between the upper and lower punching tools 23 and 25.

In order to feed and position the workpiece W to be punched, a feeding and positioning apparatus 45 is provided in a manner such that it is moved between the upper and lower arms 29 and 31 of the tool holding unit 27. The feeding and positioning apparatus 45 comprises a first carriage 47 which is movable toward and away from the upper and lower tools 23 and 25 and a second carriage 49 which is slidably mounted on the first carriage 47 and holds a clamping means 51 for clamping the workpiece W. The first carriage 47 is slidably mounted on rails 53R and 53L which are horizontally disposed on elongated plates 55R and 55L horizontally fixed to the sides of the lower arm 31 of the tool holding unit 27. The first carriage 47 is so arranged as to be moved on the rails 53R and 53L by a lead screw 57 which is horizontally provided between the fixed table 43 and the lower arm 31 of the tool holding unit 27. The lead screw 57 is connected to the first carriage 47 by means of a nut 59 and is connected to a motor 61 which is provided at the back of the tool holding unit 27. Also, the second carriage 49 holding the clamping means 51 is mounted on the first carriage 47 so that it may be moved at right angles with the rails 53R and 53L. The second carriage 49 is so arranged as to be moved by a lead screw 63 which is horizontally provided in the first carriage 47 and is connected to a motor 65. Also, a pair of movable tables 67R and 67L may be horizontally fixed to the first carriage 47 to hold the extending ends of the workpiece W to be punched. Thus, it will be understood that the tool holding unit 27 and the feeding and positioning apparatus 45 are combined with each other as such as a unit as shown in FIG. 2 and they are mounted between the overhead beam 7 and the base 3. Also a callapsible table 69 may be provided at the front end of the base 3.

In the above described arrangement, the workpiece W which is gripped by the clamping means 51 of the feeding and positioning apparatus 45 can be fed and positioned between the upper and lower punching tools 23 and 25 by moving the first carriage 47 and the second carriage 49. Before or as soon as the workpiece W is positioned between the upper and lower punching tools 23 and 25, the striker 11 held by the ram 9 is laterally moved thereon and positioned just over a desired pair of the upper and lower punching tools 23 and 25. Then, when the ram 9 is lowered, the striker 11 will be lowered to enable the desired pair of the upper and lower tools 23 and 25 to punch the workpiece W which is held by the clamping means 51 of the feeding and positioning apparatus 45. Of course, a number of holes varied in size and shape can be automatically and continuously punched in the workpiece W by moving the striker 11 on the ram 9 and the first and second carriages 47 and 49 under a numerical control which has been preprogrammed.

As has been described above, the upper punching tools 23 as well as the lower punching tools 25 are held by the tool holding unit 27 away from the overhead beam 7 which will deflect upwardly by reaction ocurring during punching operations. Accordingly, the upper and lower punching tools 23 and 25 can be kept in vertical alignment with each other to perform accurate punching operations in spite of the deflections and the resultant vibrations of the overhead beam 7 which will inevitably occur during punching operations. Also, the feeding and positioning apparatus 45, the fixed table 43 and the movable tables 67R and 67L are mounted on or connected to the base 3 not directly but by means of the lower arm 31 of the tool holding unit 27. Accordingly, the workpiece W to be cut will be subjected to less vibrations which are caused by the deflections of the overhead beam 7 occurring during punching operations, and therefore the workpiece W can be punched much more accurately.

Figure 3:
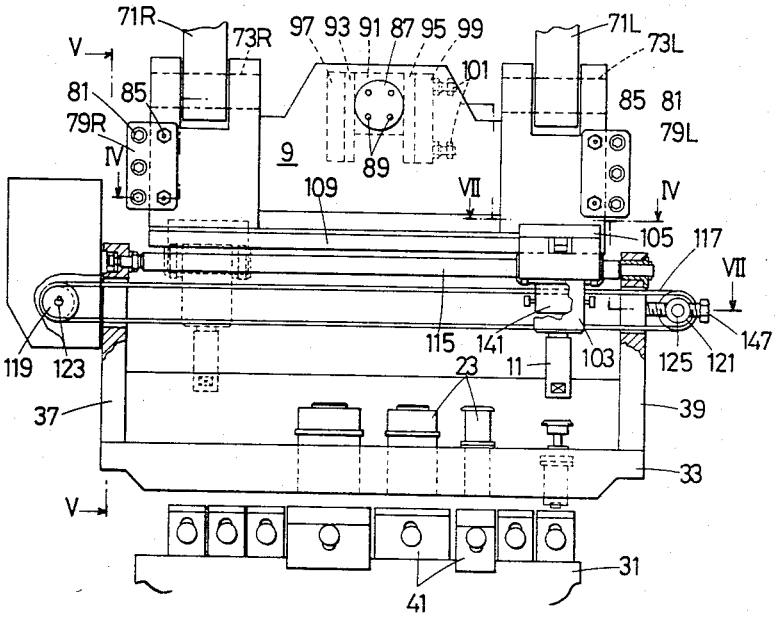
FIG. 3 is a front elevational view of a portion of the punch press shown in FIG. 1.
Figure 4:
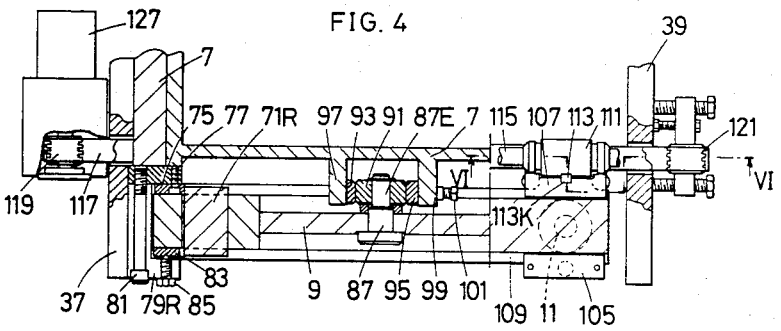
FIG. 4 is a sectional view taken along the line IV—IV of FIG. 3.
Figure 5:
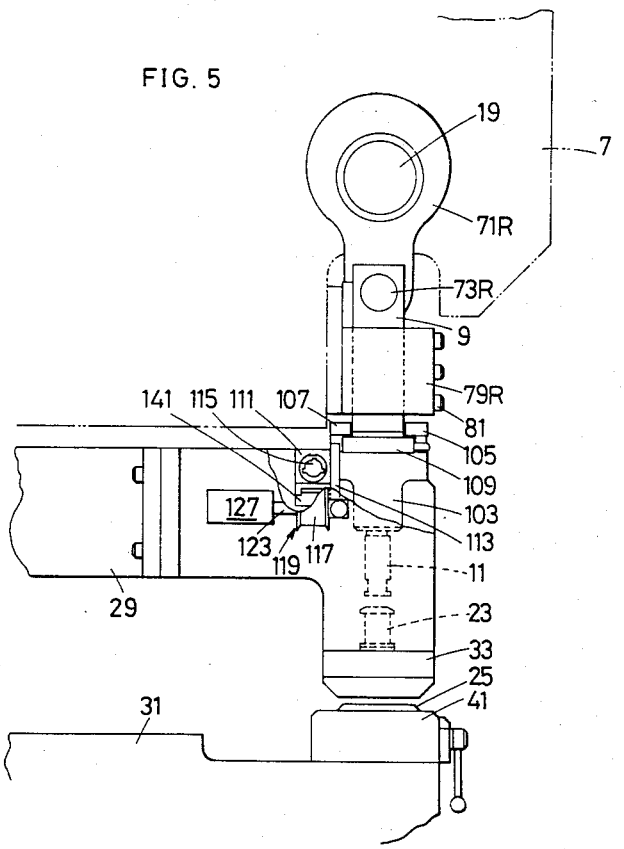
FIG. 5 is a sectional view taken along the line V—V of FIG. 3.

Referring to FIGS. 3, 4 and 5, the ram 9 is of a wide plate-like block and it is connected by a pair of connecting rods 71R and 71L by means of pins 73R and 73L to the eccentric shaft 19 which is horizontally and rotatably spanned at the front end of the overhead beam 7. The eccentric shaft 19 is connected to the motor 13 by means of the clutch 21, the flywheel 17 and the belt 15 to vertically drive the ram 9 in a conventional manner. It will be understood that the ram 9 can resist the eccentric load which will occur when the striker 11 is a acting on the upper and lower punching tools 23 and 25 in the proximity of the ends of the ram 9 long in width.

As shown in FIGS. 4 and 5, in order to guide the ram 9, a pair of guide members 75 are vertically fixed by bolts to the front end of the overhead beam 7 so that the opposite back ends of the ram 9 can be slid thereon. Also, a pair of L-shaped guide blocks 79R and 79L are fixed to the front end of the overhead beam so as to prevent the ram from swinging forwardly by means of gib members 83 which are held by bolts 85 disposed through the L-shaped guide blocks 79R and 79L. In order to adjustably guide the ram 9 to prevent the same from swinging rightward and leftward, an adjustable eccentric shaft 87 having an eccentric portion 87E is horizontally provided through the central portion of the ram 9 in such a manner as to be locked by bolts 89. The eccentric portion 87E of the eccentric shaft 87 is disposed to project rearward from the ram 9 and is rotatably connected to a slide member 91 which is vertically slidably disposed between an elongated guide 93 and a gib member 95. The guide member 93 is vertically fixed to an elongated projection 97 provided on the front end of the overhead beam 7, and a gib member 95 is vertically and adjustably held by a plurality of adjustable bolts 101 on another elongated projection 99 provided on the front end of the overhead beam 7.

In the above described arrangement, the ram 9 is guided at its opposite ends by the guide members 75 and the L-shaped guide blocks 79R and 79L without swinging forwardly and rearwardly when moving up and down. The ram 9 is also guided without swinging rightward and leftward by the slide member 91 which can be adjusted in position so as to enable the ram 9 to move up and down properly.

Figure 6:
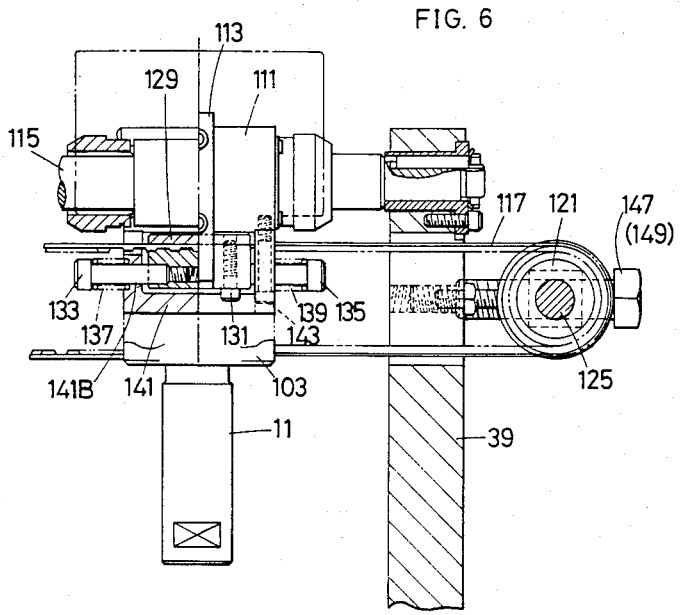
FIG. 6 is an enlarged sectional view taken along the line VI—VI of FIG. 4.
Figure 7:
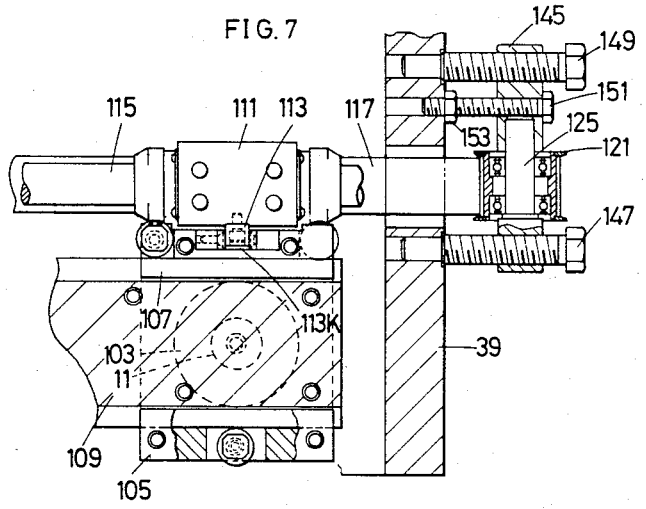
FIG. 7 is an enlarged sectional view taken along the line VII—VII of FIG. 3.

Referring to FIGS. 6 and 7 in addition to FIGS. 3 through 5, the striker 11 is laterally slidably provided at the lower end of the ram 9 so that it can selectively act on either pair of the upper and lower punching tools 23 and 25 as has been described hereinbefore. For this purpose, the striker 11 is integrally connected to a holding member 103 which is provided at its top with a pair of slide plates 105 and 107 and is formed with a vertical key way 113K, and the holding member 103 is slidably mounted on a rail 109 which is horizontally fixed to the lower end of the ram 9. More particularly, the holding member 103 of the striker 11 is provided at the lower end of the ram 9 with its slide plates 105 and 107 slidably placed on the rail 109 in such a manner as to depend vertically therefrom so as to hold the striker 11 vertical. In order to positively and accurately guide the striker 11, a spline nut 111 having a vertical guide key 113 is slidably provided on a spline shaft 115 which is horizontally disposed on the tool holding unit 27 in a manner such that the guide key 113 is in slidable engagement with the key way 103K of the holding member 103 of the striker 11. In this arrangement, the striker 11 can be positively and accurately moved along the rail 109 by the holding member 103 which is connected by means of the key way 113K and the key 113 to the spline nut 111 guided on and along the spline shaft 115. Also, it will be understood that the striker 11 can be lowered along the key 113 of the spline nut 111 to act on the upper and lower punching tools 23 and 25 when the ram 9 is lowered.

As best shown in FIGS. 3 and 4, in order to move the striker 11 along the rail 109, the spline nut 111 is connected to a driving belt 117 such as a timing belt which is trained around a driving pulley 119 and a driven pulley 121 having shafts 123 and 125, respectively. The driving pulley 119 is connected to a motor 127 which is mounted on the bracket 37 of the tool holding unit 27, and the driven pulley 121 is provided on the bracket 39 of the tool holding unit 27. Thus, when the driving pulley 119 is driven by the motor 127 to drive the driving belt 117, the spline nut 111 is moved by the driving belt 117 along the spline shaft 115 to move the striker 11 by means of the holding member 103 along the rail 109.

Referring to FIGS. 6 and 7, the driving belt 117 is connected to the spline nut 111 by means of a connecting member 129 connected to the driving belt 117 by a plurality of bolts 131, a pair of bolts 133 and 135 fixed to the connecting member 129 and having springs 137 and 139 and a casing 141 fixed to the spline nut 111. The casing 141 is of a box-like square frame, and it is fixed to the underside of the spline nut 111 by a plurality of bolts 143 in such a manner as to surround the connecting member 129 to which the driving belt 117 is fixed. In the preferred embodiment, the shafts 123 and 125 of the driving and driven pulleys 119 and 121 are horizontally disposed to keep the stretches of the driving belt 117 horizontal and vertically aligned with each other, and the connecting member 129 is fixed by the bolts 131 to the underside of the upper stretch of the driving belt 117. Also, the casing 141 is so arranged that the upper stretch of the driving belt 117 will horizontally pass therethrough and the connecting member 129 will be located therein. The bolts 133 and 135 are horizontally fixed to the opposite sides of the connecting member 129 beneath and in parallel with the upper stretch of the driving belt 117 in a manner such that they are symmetrically projected out of the casing 141 through bores 141B formed therethrough. The bolts 133 and 135 are disposed to freely pass through the bores 141B of the casing 141, and the springs 137 and 139 are provided on the projecting portions of the bolts 133 and 135, respectively, to outwardly bias the bolts 133 and 135.

In the above described arrangement, the driving belt 117, when driven on the driving and driven pulleys 119 and 121, will move the spline nut 111 on the spline shaft 115 by means of the connecting member 129, the bolts 133 and 135, the springs 137 and 139 and the casing 141 to move the striker 11 along the rail 109. Thus, it will be understood that the shocks and vibrations occurring during punching operations will be absorbed by the springs 137 and 139 and will not be transmitted to the driving and driven pulleys 119 and 121 and the motor 127. Accordingly, it will be also understood that the driving and driven pulleys 119 and 121 and the motor 127 can have longer lives without being subjected to the shocks and vibrations occuring during punching operations.

Referring again to FIGS. 6 and 7, in order to adjust the tension of the driving belt 117 and also change the driving belt 117, the driven pulley 121 is so arranged that it can be easily adjusted in position and easily removed. For this purpose, the rear end of the shaft 125 of the driven pulley 121 is detachably journaled into connected to a supporting member 145, and the front end of the shaft 125 and the holding member 145 are secured to the bracket 39 of the tool holding unit 27 by means of screws 147 and 149, respectively. Also, the supporting member 145 supporting the shaft 125 of the driven pulley 121 is releasably fixed to the bracket 39 of the tool holding unit 27 by a bolt 151 having a lock nut 153. Thus, the tension of the driving belt 117 can be adjusted by rotating the screws 147 and 149, and of course the driven pulley 121 can be removed to change the driving belt 117 by removing the screw 147 and 149.

Although a preferred form of the present invention has been illustrated and described, it should be understood that the device is capable of modification by one skilled in the art without departing from the principles of the invention. Accordingly, the scope of the invention is to be limited only by the claims appended hereto.

I claim:

1. A punch press comprising:

a frame having an overhead beam and a base portion;

a vertically movable ram mounted at a front end of the overhead beam;

a tool holder having upper and lower arms and being disposed on the base portion of the frame with a gap between the tool holder and the overhead beam;

a plurality of upper punching tools disposed at a front end of the upper arm of the tool holder;

a plurality of lower tools corresponding to the upper tools disposed at a front end of the lower arm of the tool holder;

a striker mounted on the ram so as to hit each of the upper punching tools; and a workpiece feeding and positioning means disposed on said tool holder;

said tool holder being disposed on said frame so as to reduce the amount of vibration and deflection that are transferred from the overhead beam to the punching tools and workpiece feeding and positioning means.

2. A punch press according to claim 1, wherein the ram extends along the direction of the plurality of upper punching tools and the striker is movable along the ram.

3. The punch press according to claim 1, further comprising an eccentric shaft rotatably supported by the front end of the overhead beam, said shaft being connected to the ram so as to vertically drive the ram.

4. The punch press according to claim 3, further comprising guide means disposed on the overhead beam and slide means adjustably connected to the ram and slidably disposed within the guide means for guiding the ram.

5. The punch press according to claim 4, wherein the ram is of a width extending in a direction along the plurality of upper punching tools.

6. The punch press according to claim 5, further comprising:

drive belt means;

a fixing block fixed to the drive belt means;

spring means mounted to the fixing block; and moving means connected to the fixing block via the spring means for moving the striker along the ram so as to align the striker with the plurality of upper punching tools.

7. A punch press, comprising:

a frame having an upper and lower portion;

tool holding means mounted on the lower portion of the frame for holding upper and lower punching tools;

a ram mounted to the upper portion of the frame;

striking means adjustably mounted on the ram so as to be selectively aligned with the upper punching tools;

means for moving the striking means along the ram for purposes of adjusting the striking means;

spring means for interconnecting the striking means and the moving means so that shocks and vibrations occuring during punching operations will not be transmitted to the moving means.

8. The punch press according to claim 7, wherein said moving means comprises belt means, driving means for driving the belt means and casing means connected to said belt means.

9. The punch press according to claim 8, further comprising guide means disposed on the upper portion of the frame and slide means adjustably connected to the ram and slidably disposed within the guide means for guiding the ram.

10. The punch press according to claim 9, wherein said slide means includes a slide member and an eccentric member rotatably disposed within the slide member, said eccentric member being connected to the ram so that leftward and rightward adjustment of the ram may be accomplished by rotating the eccentric member.

* * * * *